United States Patent [19]

Habu et al.

[11] 4,318,979

[45] Mar. 9, 1982

[54] LIGHT-SENSITIVE SILVER HALIDE PHOTOGRAPHIC MATERIAL

[75] Inventors: Takeshi Habu; Chika Honda, both of Hino, Japan

[73] Assignee: Konishiroku Photo Industry Co., Ltd., Tokyo, Japan

[21] Appl. No.: 215,011

[22] Filed: Dec. 10, 1980

Related U.S. Application Data

[63] Continuation of Ser. No. 70,846, Aug. 29, 1979, abandoned.

[30] Foreign Application Priority Data

Sep. 7, 1978 [JP] Japan ..... 53-109910

[51] Int. Cl.[3] ..... G03C 1/06; G03C 5/24

[52] U.S. Cl. ..... 430/434; 430/436; 430/437; 430/439; 430/438; 430/440; 430/442; 430/141; 430/170; 430/564; 430/614; 430/612; 430/600; 430/949

[58] Field of Search ..... 430/434, 436, 437, 439, 430/438, 440, 442, 170, 141, 564, 614, 949, 600, 612, 149

[56] References Cited

U.S. PATENT DOCUMENTS

| | | | |
|---|---|---|---|
| 2,839,405 | 6/1958 | Jones | 430/608 |
| 3,488,709 | 1/1970 | Sidebotham | 430/608 |
| 3,556,797 | 1/1971 | Pattijn et al. | 430/612 |
| 3,891,442 | 6/1975 | Beavers | 430/564 |
| 3,901,712 | 8/1975 | Beavers | 430/564 |
| 4,169,733 | 10/1979 | Iytaka et al. | 430/949 |

OTHER PUBLICATIONS

Derwent Abstract: 09348 Y/06, E 19 G06, 02-08-1975, JA-094295 (02-02-77).

*Primary Examiner*—Won H. Louie, Jr.
*Attorney, Agent, or Firm*—Frishauf, Holtz, Goodman & Woodward

[57] ABSTRACT

A light-sensitive silver halide photographic material comprising a combination of a salt of tetrazolium containing only a non-metallic anion and a salt of tetrazolium containing a metallic anion.

10 Claims, No Drawings

LIGHT-SENSITIVE SILVER HALIDE PHOTOGRAPHIC MATERIAL

This is a continuation of application Ser. No. 70,846 filed Aug. 29, 1979, now abandoned.

This invention relates to a novel light-sensitive silver halide photographic material and particularly to a novel lith-type light-sensitive silver halide photographic material for obtaining a photographic image with especially high contrast, high sharpness and high resolving power.

More particularly, this invention relates to a high-contrast light-sensitive silver halide photographic material that is advantageously employed for forming a line- or dot-image. Accordingly, this invention relates particularly to a lith-type light-sensitive silver halide photographic material for printing and to a light-sensitive material for copying.

A high-contrast photographic characteristic bringing about only maximum and minimum concentration portions (so-called fringe) is necessary for obtaining a dot- or line image required in the printing processes.

For the purpose of forming such a photographic image as stated above, a process involving the combination of a high-contrast light-sensitive photographic material and a developer (lith-type developer) capable of developing said material infectiously is known.

As for said lith-type developer, there is a detailed description in J.A.C. Yule, Journal of the Franklin Institute, vol. 239, page 221 (1945).

The lith-type developer, however, is poor in maintaining its activity during storage. Therefore, a plate maker is required to control the developer for maintaining the activity of the developer, which changes on standing, at a constant level in order to obtain a halftone negative or halftone positive image with high quality. The control required in the above-mentioned process involves disadvantageously complicated procedures and, if the automatic procedures are adopted, they should require uneconomical expense.

The lith-type developer contains inherently the low-concentration of the sulfite ion and also contains inherently the relatively high concentration of the hydroquinone developing agent in an aqueous alkaline solution, so that automatic oxidation is apt to take place. This is the reason why the lith-type developer is poor in storage stability.

Many proposals on the improvement of the storage stability have been previously made. One of the proposals suggests that a light-sensitive silver halide photographic material containing a tetrazolium compound which yields a high contrast silver image even when the photographic material be developed by a so-called PQ-type or MQ-type conventional developer (e.g., a developer based on the Phenidone ®/Hydroquinone or Metol ®/Hydroquinone mixture as developing agents, respectively) having the sufficiently high concentration of the sulfite ion, as disclosed, for instance, by Japanese Patent Provisional Publication 52(1977)-18,317. By the addition of the tetrazolium compound, the photographic material can be developed in a conventional developer that has excellent storage stability. Nevertheless, the light-sensitive silver halide photographic material containing the tetrazolium compound is, on the contrary, poor in storage stability, that is, said photographic material yields a dot-image whose contrast lowers when it was stored for long time at room temperature before exposure.

Accordingly, it is the primary object of the invention to provide a light-sensitive silver halide photographic material that can yield a black-and-white silver image, particularly a dot- or line-image, with high contrast even when developed in a stable developer and that has sufficient storage stability. Other objects of the invention are apparent from the description set forth hereinafter.

As a result of the study, the present inventors have found that the objects can be accomplished by incorporating the combination of a salt of tetrazolium containing only a non-metallic anion and a salt of tetrazolium containing a metallic anion into a light-sensitive silver halide photographic material.

The salt of tetrazolium containing only a non-metallic anion has Formula (I), and the salt of tetrazolium containing a metallic anion has Formula (II):

Formula (I): $[T^{n\oplus}][X_1^{\ominus}]_n$

Formula (II): $[T^{n\oplus}]_{m1}[X_2^{m\ominus}]$

In the above formulae, T represents a tetrazolium cation, $X_1$ represents an anion containing only non-metallic atoms, $X_2$ represents an anion containing a metal atom, n is 1 or 2, m is an integer of 1 to 3, and $m_1$ is an integer yielding that n multiplied by $m_1$ is equal to m.

In formula (I), T has the formula (I-a), (I-b) or (I-c).

(I-a):

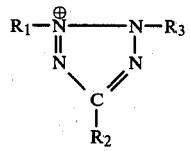

(I-b):

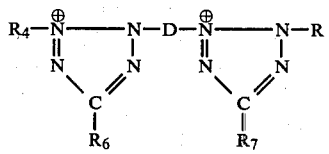

(I-c):

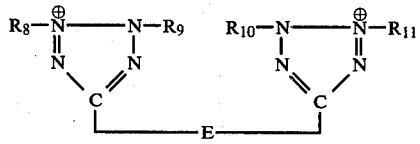

In formulae (I-a), (I-b) and (I-c), $R_1$, $R_2$, $R_3$, $R_4$, $R_5$, $R_6$, $R_7$, $R_8$, $R_9$, $R_{10}$ and $R_{11}$, which may be the same or different, are hydrogen or halogen atoms, amino, nitro, cyano, mercapto, hydroxy, carboxy, alkyl, alkenyl, alkoxy, alkoxycarbonyl, aryl, acyl or heterocyclic groups, or groups that are capable of forming metallic chelate compounds or complex compounds. The last groups set forth in the above sentence are ones that act as electron donor to form coordination compounds with metal ions, and are exemplified by pyridyl and dipyridyl groups. The above-listed amino, alkyl, alkenyl, alkoxy, alkoxycarbonyl, aryl and heterocyclic groups can have one or more substituents, such as halogen, amino, nitro, cyano, mercapto, alkyl, hydroxy, alkenyl, alkoxycarbonyl, aryl or a hetero-cyclic group.

In these formulae, D and E, which may be the same or different, are arylene groups such as phenylene and naphthylene, or alkylene groups, preferably having 1 to 18 carbon atoms, such as methylene, octamethylene, propylene, butylene and octadecylene. These arylene and alkylene groups can have one or more substituents, such as amino, nitro, cyano, mercapto, hydroxy, carboxy, alkyl, alkenyl, alkoxycarbonyl, aryl or a heterocyclic group.

In these formulae (I-a), (I-b) and (I-c), the alkyl group preferably contains 1 to 32 carbon atoms and its examples include methyl, butyl, octyl, octadecyl and eicosyl; the alkenyl group preferably contains 2 to 20 carbon atoms and its example includes allyl, butenyl, octenyl or octadecyl; the aryl group preferably is phenyl or naphthyl group including, for example, phenyl, hydroxyphenyl, aminophenyl, carboxyphenyl, nitrophenyl, alkylphenyl, sulfophenyl, alfa-naphthyl, beta-naphthyl, hydroxynaphthyl, carboxynaphthyl and aminonaphthyl; the alkoxy group preferably contains 1 to 32 carbon atoms including, for example, methoxy, ethoxy and octadecyloxy; and the alkoxycarboxy group preferably contains 2 to 32 carbon atoms including, for example, methoxycarbonyl, ethoxycarbonyl and octadecyloxy. Example of the heterocyclic group includes oxazolyl, thiazolyl, imidazolyl, benzoxazolyl, benzthiazolyl, benzimidazolyl, selenazolyl, benzselenazolyl, quinonyl, quinazolyl, triazyl, naphthoxazolyl, pyridyl, pyrimidyl, indazolyl, furyl, oxadinyl, thienylmorpholino, piperidyl and tetrazolyl, and the heterocyclic group preferably is a five or six-membered heterocyclic group or condensed heterocyclic group containing nitrogen, oxygen and/or sulfur atoms. The halogen atom is, for instance, a chlorine, bromine or iodine atom.

In the formulae (I-a), (I-b) and (I-c), particularly preferred groups for $R_1$, $R_2$, $R_3$, $R_4$, $R_5$, $R_6$, $R_7$, $R_8$, $R_9$, $R_{10}$ and $R_{11}$ are substituted or unsubstituted aryl groups.

Among the groups of the formulae identified above, the most preferred is a group represented by the formula (I-a) followed by a group represented by the formula (I-b) which is further followed by a group represented by the formula (I-c). The utmost preferred group is a group represented by the formula (I-a) in which $R_1$, $R_2$ and $R_3$ are the substituted or unsubstituted phenyl groups.

$X_1$ represents an anionic atom or group containing only non-metallic atoms and is exemplified by a halogen atom and groups of the formulae (I-d), (I-e), (I-f), (I-g) and (I-h).

Formula (I-d)

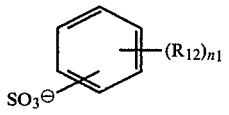

In Formula (I-d), $R_{12}$ represents an alkyl group preferably containing 14 to 32 carbon atoms, whose example includes tetradecyl, hexadecyl and octadecyl. Said alkyl can be substituted by an optional substituent, for example, a halogen atom such as a chlorine or bromine atom. Alternatively, $R_{12}$ represents a group of the formula:

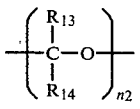

in which $R_{13}$ and $R_{14}$, which may be the same or different, represent hydrogen, halogen such as chlorine or bromine, alkyl such as methyl, ethyl or butyl or phenyl, said alkyl and phenyl being optionally substituted by alkyl (e.g., methyl, ethyl, propyl, isopropyl or butyl) or halogen (e.g., chlorine or bromine). $n_1$ is an integer of 1 to 3. $n_2$ is an integer of 1 to 20.

Formula (I-e)

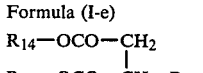

Formula (I-f)

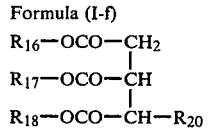

In the formulae (I-e) and (I-f), $R_{14}$, $R_{15}$, $R_{16}$, $R_{17}$ and $R_{18}$, may be the same or different. Each of them represents a halogen atom such as chlorine or bromine atom, or an alkyl group containing preferably 1 to 32 carbon atoms, whose example includes, a methyl, ethyl, butyl, isobutyl, pentyl, hexyl, octyl, nonyl, decyl or dodecyl or octadecyl group. Said alkyl group can be substituted by halogen such as chlorine or bromine or aryl such as phenyl or naphthyl. $R_{19}$ and $R_{20}$, which may be the same or different, are carboxy, sulfo or phosphoric acid groups.

Formula (I-g)

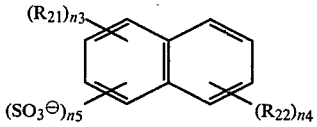

In formula (I-g), $R_{21}$ and $R_{22}$, which may be the same or different, represent a hydrogen or halogen atom, or an alkyl or alkenyl group containing preferably 1 to 18 carbon atoms, for example, methyl, ethyl, butyl, isobutyl, octyl, allyl, butenyl and octenyl. $n_3$, $n_4$ and $n_5$, which may be the same or different, are integers of 1 to 3.

Formula (I-h)

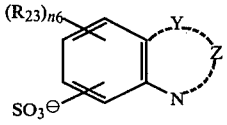

In Formula (I-h), Y represents a sulfur, selenium, oxygen or nitrogen atom or a divalent residual group of the formula—$NR_{24}$—in which $R_{24}$ is hydrogen, alkyl or aryl. Z represents an atomic group required for completing a five- or six-membered hetero-ring containing oxygen selenium or nitrogen as a hetero atom, such as a thiazole, selenazole, oxazole, imidazole, pyrazole, triazole, tetrazole, pyrimidine or triazine ring. On the carbon atoms of said hetero-ring, there can be placed a variety of substituents, for instance, alkyl containing 1 to 20 carbon atoms, such as, methyl, ethyl, n-butyl, heptyl or octadecyl, alkoxy containing 1 to 20 carbon atoms, such as, methoxy, ethoxy, dodecyloxy or heptadecyloxy, alkylthio containing 1 to 20 carbon atoms, such as, methylthio, ethylthio or butylthio. $R_{23}$ has the same meaning as $R_{22}$. $n_6$ is 1 or 2.

Examples of the group T and the anion $X_1\ominus$ of Formula (I) representing the compound employed in this invention are listed below, but these examples are not intended to limit this invention.

| Examples for T | |
|---|---|
| T - (1) | 2-(Benzothiazol-2-yl)-3-phenyl-5-dodecyl-2H-tetrazolium |
| T - (2) | 2,3-Diphenyl-5-(4-t-oxtyloxyphenyl)-2H-tetrazolium |
| T - (3) | 2,3,5-Triphenyl-2H-tetrazolium |
| T - (4) | 2,3,5-Tri(p-carboxyethylphenyl)-2H-tetrazolium |
| T - (5) | 2-(Benzothiazol-2-yl)-3-phenyl-5-(o-chloro-phenyl)-2H-tetrazolium |
| T - (6) | 2,3-Diphenyl-2H-tetrazolium |
| T - (7) | 2,3-Diphenyl-5-methyl-2H-tetrazolium |
| T - (8) | 3-(p-Hydroxyphenyl)-5-methyl-2-phenyl-2H-tetrazolium |
| T - (9) | 2,3-Diphenyl-5-ethyl-2H-tetrazolium |
| T - (10) | 2,3-Diphenyl-5-n-hexyl-2H-tetrazolium |
| T - (11) | 5-Cyano-2,3-diphenyl-2H-tetrazolium |
| T - (12) | 2-(Benzothiazol-2-yl)-5-phenyl)-3-(4-tolyl)-2H-tetrazolium |
| T - (13) | 2-(Benzothiazol-2-yl)-5-(4-chlorophenyl)-3-(4-nitrophenyl)-2H-tetrazolium |
| T - (14) | 5-Ethoxycarbonyl-2,3-di(3-nitrophenyl)-2H-tetrazolium |
| T - (15) | 5-Acetyl-2,3-di(p-ethoxyphenyl)-2H-tetrazolium |
| T - (16) | 2,5-Diphenyl-3-(p-tolyl)-2H-tetrazolium |
| T - (17) | 2,5-Diphenyl-3-(p-iodophenyl)-2H-tetrazolium |
| T - (18) | 2,3-Diphenyl-5-(p-diphenyl)-2H-tetrazolium |
| T - (19) | 5-(p-Bromophenyl)-2-phenyl-3-(2,4,6-trichloro-phenyl)-2H-tetrazolium |
| T - (20) | 3-(p-Hydroxyphenyl)-5-(p-nitrophenyl)-2-phenyl-2H-tetrazolium |
| T - (21) | 5-(3,4-Dimethoxyphenyl)-3-(2-ethoxyphenyl)-2-(4-methoxyphenyl)-2H-tetrazolium |
| T - (22) | 5-(4-Cyanophenyl)-2,3-diphenyl-2H-tetrazolium |
| T - (23) | 3-(p-Acetamidophenyl)-2,5-diphenyl-2H-tetrazolium |
| T - (24) | 5-Acetyl-2,3-diphenyl-2H-tetrazolium |
| T - (25) | 5-(Fur-2-yl)-2,3-diphenyl-2H-tetrazolium |
| T - (26) | 5-(Thien-2-yl)-2,3-diphenyl-2H-tertrazolium |
| T - (27) | 2,3-Diphenyl-5-(pyrido-4-yl)-2H-tetrazolium |
| T - (28) | 2,3-Diphenyl-5-(quinol-2-yl)-2H-tetrazolium |
| T - (29) | 2,3-Diphenyl-5-(benzoxazol-2-yl)-2H-tetrazolium |
| T - (30) | 2,3-Diphenyl-5-nitro-2H-tetrazolium |
| T - (31) | 2,2',3,3'-Tetraphenyl-5,5'-1,4-butylen-di-(2H-tetrazolium) |
| T - (32) | 2,2',3,3'-Tetraphenyl-5,5'-p-phenylen-di-(2H-tetrazolium) |
| T - (33) | 2-(4,5-Dimethylthiazol-2-yl)-3,5-diphenyl-2H-tetrazolium |
| T - (34) | 3,5-Diphenyl-2-(triazin-2-yl)-2H-tetrazolium |
| T - (35) | 2-(Benzothiazol-2-yl)-3-(4-methoxyphenyl)-5-phenyl-2H-tetrazolium |
| T - (36) | 3,3'-(3,3'-Dimethoxy-4,4'-biphenylen)-bis[2-(p-nitrophenyl)-5-phenyl-2H-tetrazolium] |
| T - (37) | 3,3'-(3,3'-Dimethoxy-4,4'-biphenylen)-bis(p-nitrophenyl)-5-(p-thiocarbamylphenyl)-2H-tetrazolium |
| T - (38) | 3,3'-(3,3'-Dimethoxy-4,4'-biphenylen)-bis[2,5-bis(p-nitrophenyl)-2H-tetrazolium] |
| T - (39) | 3,3'-(3,3'-Dimethoxy-4,4'-biphenylen)-bis/2,5-diphenyl-2H-tetrazolium) |
| T - (40) | 2,5-Diphenyl-3-β-naphthyltetrazolium |
| T - (41) | 2-p-Iodophenyl-3-p-nitrophenyl-5-phenyl-2H-tetrazolium |

Examples for $X_1^{\ominus}$ $X_1$ - (1)

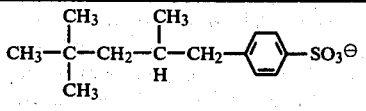

$X_1$ - (2)

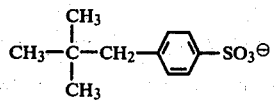

$X_1$ - (3)

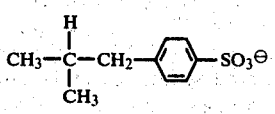

-continued $X_1$ - (4)

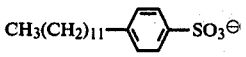

$X_1$ - (5)

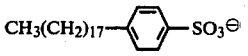

$X_1$ - (6)

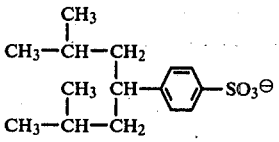

$X_1$ - (7)

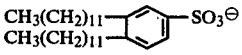

$X_1$ - (8)

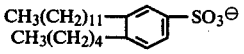

$X_1$ - (9)

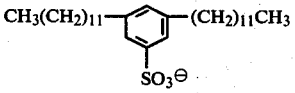

$X_1$ - (10)

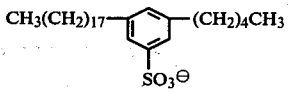

$X_1$ - (11)

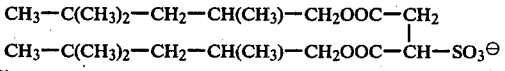

$X_1$ - (12)

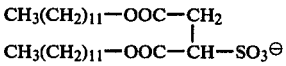

$X_1$ - (13)

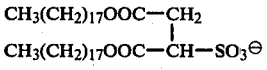

$X_1$ - (14)

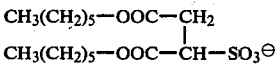

$X_1$ - (15)

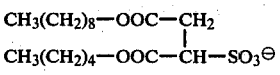

$X_1$ - (16)

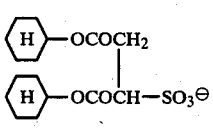

$X_1$ - (17)

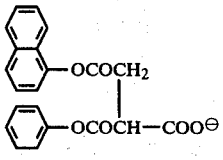

$X_1$ - (18)

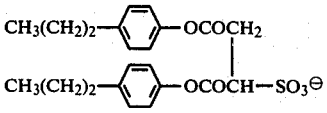

-continued $X_1$ - (19)

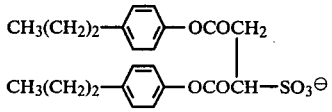

$X_1$ - (20)

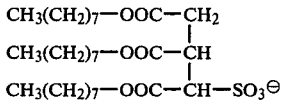

$X_1$ - (21)

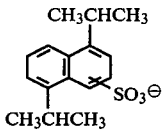

$X_1$ - (22)

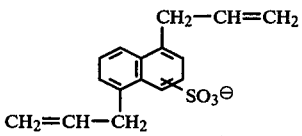

$X_1$ - (23)

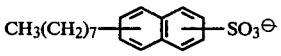

$X_1$ - (24)

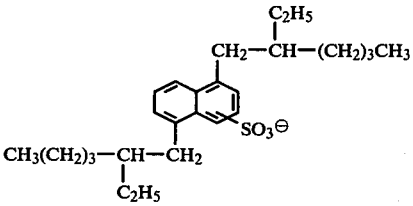

$X_1$ - (25)

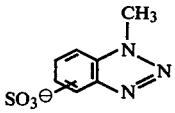

$X_1$ - (26)

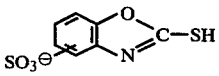

$X_1$ - (27)

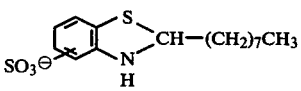

$X_1$ - (28)

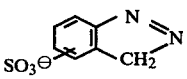

$X_1$ - (29)

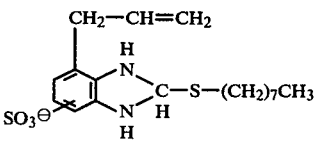

$X_1$ - (30)

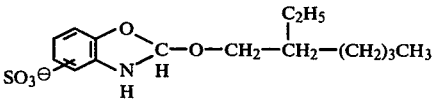

$X_1$ - (31)

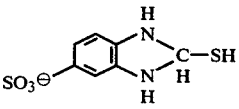

-continued $X_1$ - (32)

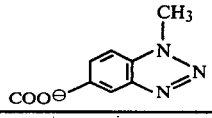

Examples of compounds represented by Formula (I) consisting of the cation part (T) and the anion part ($X_1$) are listed below.

| | |
|---|---|
| I - 1 | 2,3-Diphenyl-5-(4-o-octyloxyphenyl)-2H-tetrazolium 3,5,5-trimethylhexylsulfosuccinate |
| I - 2 | 2,3,5-Tri(p-carboxyethylphenyl)-2H-tetrazolium 2,2-diethylhexylsulfosuccinate |
| I - 3 | 2,3-Diphenyl-2H-tetrazolium dodecylbenzenesulfonate |
| I - 4 | 2,3-Diphenyl-5-ethyl-2H-tetrazolium 3,5-didodecylbenzene-1-sulfonate |
| I - 5 | 5-Cyano-2,3-diphenyl-2H-tetrazolium diisopropylnaphthalenesulfonate |
| I - 6 | 5-Ethoxycarbonyl-2,3-di(3-nitrophenyl)-2H-tetrazolium 1-methyl-benztriazolsulfonate |
| I - 7 | 2,5-Diphenyl-3-(p-tolyl)-2H-tetrazolium 2-mercaptobenzoxazolsulfonate |
| I - 8 | 2,3,5-Triphenyltetrazolium 3,5,5-trimethylhexylsulfosuccinate |
| I - 9 | 2,5-Diphenyl-3-(p-methoxyphenyl)tetrazolium t-amylsulfosuccinate |
| I - 10 | 2,3,5-Triphenyltetrazolium 2-mercaptobenzoimidazolsulfonate |
| I - 11 | 3-(p-Hydroxyphenyl)-5-methyl-2-phenyl-2H-tetrazolium cyclohexylsulfosuccinate |
| I - 12 | 2,3-Diphenyl-5-(p-diphenyl)-2H-tetrazolium isopropylbenzenesulfosuccinate |
| I - 13 | 2,3-Diphenyl-5-n-hexyl-2H-tetrazolium indazolsulfonate |
| I - 14 | 2,3-Diphenyl-5-(p-ethylphenyl)-tetrazolium 2-octylbenzothiazolsulfosuccinate |
| I - 15 | 2-(p-Nitrophenyl)-3,5-diphenyltetrazolium 1,5-dipropenylnaphthalenesulfonate |

The compound represented by Formula (I) of this invention can be prepared by combining optionally a halide (e.g., chloride or bromide) containing the cation part T and an alkali metal (e.g., sodium or potassium) salt containing the anion part $X_1$.

The halide containing the cation part T of this invention can be readily prepared, for instance, by the method described in Chemical Review, vol. 55, page 335–483.

Representative examples of the preparations of the compounds represented by Formula (I) are set forth below. Hereinafter percentage is represented by means of volume to volume.

EXAMPLE OF PREPARATION 1

To 1 liter of aqueous solution of 5-cyano-2,3-diphenyl-2H-tetrazolium chloride (5%) was added 500 ml of aqueous solution of diisopropylnaphthalenesulfonic acid (10%), and the resulting precipitate was collected by filtration, washed and dried to yield a product corresponding to Formula I-5.

EXAMPLE OF PREPARATION 2

To 1 liter of aqueous solution of 2,5-diphenyl-3-(p-tolyl)-2H-tetrazolium chloride (5%) was added little by little at room temperature 200 ml of aqueous 2-mercaptobenzoxazolsulfonic acid (0.5%), and the resulting precipitate was collected by filtration, washed and dried to yield a product corresponding to Formula I-7.

EXAMPLE OF PREPARATION 3

To 1 liter of aqueous solution of 2,3,5-triphenyltetrazolium chloride (5%) was added little by little at room temperature 350 ml of aqueous 3,5,5-trimethylhexylsulfosuccinic acid (5%), and the resulting mixture was placed in a separatory funnel. To the mixture was added 500 ml of chloroform, and after stirring the chloroform phase (underlayer) was separated. Upon evaporation of the chloroform by heating, there was obtained a product corresponding to Formula I-8. Reextract with chloroform yielded 36 g. of an oily product.

EXAMPLE OF PREPARATION 4

To 1 liter of aqueous solution of 2,3,5-triphenyltetrazolium chloride (5%) was added little by little 600 ml of aqueous solution of 2-mercaptobenzoimidazol-5-sulfonic acid (1%), and the resulting precipitate was collected by filtration, washed and dried to yield a product corresponding to Formula I-10. Yield: 9.8 g.

EXAMPLE OF PREPARATION 5

To 1 liter of a solution of 2-(p-nitrophenyl)-3,5-diphenyltetrazolium chloride in a mixture of fluorinated alcohol and water (5%) was added little by little 350 ml of 1,5-dipropenyl naphthalenesulfonate solution (5%), and the resulting precipitate was collected by filtration, washed and dried to yield a product corresponding to Formula I-15. Yield: 29 g.

The compound of Formula (I) which can be prepared by the methods stated in the above examples using a tetrazolium halide containing the cation part T (TX) and an alkali metal salt such as an alkali metal chloride containing the anion part $X_1$ ($X_1A$) may be incorporated into a hydrophilic colloid of a light-sensitive silver halide photographic material. Alternatively, the compound TX and the compound $X_1A$, both being in the form of an aqueous solution of an appropriate concentration, a solution in a water-miscible organic solvent such as methyl alcohol or fluorinated alcohol, or a dispersion in a gelatin matrix of latex, can be incorporated into a hydrophilic colloid of a light-sensitive silver halide photographic material.

In Formula (II), T represents a group as described for Formula (I), and m is an integer of 1 to 3. $X_2$ represents an atomic group or a group having the formulae (II-a), (II-b), (II-c), (II-d), (II-e), (II-f), (II-g) and (II-h).

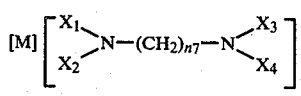

Formula (II-a)

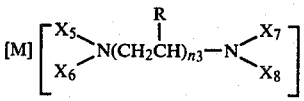

Formula (II-b)

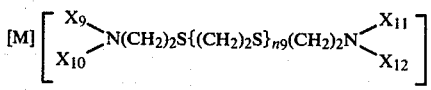

Formula (II-c)

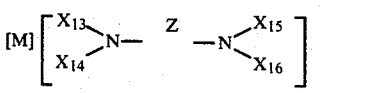

Formula (II-d)

-continued

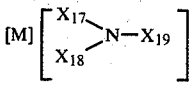

Formula (II-e)

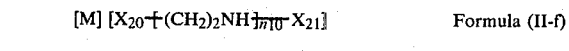

Formula (II-f)

Formula (II-g)

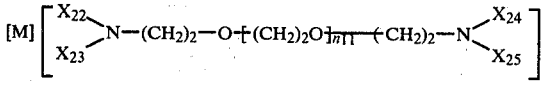

Formula (II-h)

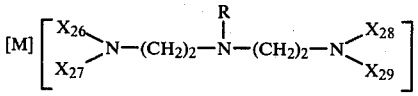

In the above formulae (II-a) through (II-h), $X_1$, $X_2$, $X_3$, $X_4$, $X_5$, $X_6$, $X_7$, $X_8$, $X_9$, $X_{10}$, $X_{11}$, $X_{12}$, $X_{13}$, $X_{14}$, $X_{15}$, $X_{16}$, $X_{17}$, $X_{18}$, $X_{19}$, $X_{20}$, $X_{21}$, $X_{22}$, $X_{23}$, $X_{24}$, $X_{25}$, $X_{26}$, $X_{27}$, $X_{28}$ and $X_{29}$, which may be the same or different, represent groups $-(CH_2)_{n17}COO^{\ominus}[T^{\oplus}]$ or $-(CH_2)_{n17}COOH$ in which $n_{17}$ is an integer of 1 to 4. R in the formulae (II-b) and (II-h) represents alkyl such as methyl, ethyl or butyl, hydroxy, alkoxy, $-NH_2$, $-(CH_2)_{n17}COO^{63}[T^{\oplus}]$, $-(CH_2)_{n17}COOH$, $-PO_3H^{\ominus}[T^{61}]-PO_3H_2$ in which $T^{\oplus}$ has the same meaning as defined for Formula I.

In Formula (II-d), Z represents a group of atoms necessary to form a five- or six-membered ring, and the ring preferably consists of carbon, nitrogen, oxygen and/or sulfur atoms and more preferably is a five- or six-membered ring consisting of carbon atoms such as a cyclohexane or cyclopentane ring.

In the above-illustrated formulae $n_7$, $n_8$, $n_9$ and $n_{11}$, which may be the same or different, are integers of 1 to 10.

In the formula (II-a) through (II-h), M represents a metal atom such as iron, cobalt, nickel, copper, manganese, lead, chromium, titanium, cerium, samarium, europium or ytterbium, and M preferably is such a metal atom as divalent copper, trivalent iron, cobalt, nickel, samarium, europium, chromium or ytterbium, or tetravalent titanium, cerium or lead, especially preferable are trivalent iron, cobalt and nickel.

A metal atom of the metal-chelate compound represented by Formula (II) is supposed to enhance the storage stability of the light-sensitive silver halide photographic material on the ground that other molecules (T and $X_2$ of the present invention) are connected to the metal by the coordination bond through the atomic bonding orbital of the metal in the form of octahedral, tetrahedral, planer or the like.

Examples of $X_2^{m\ominus}$ of Formula (II) representing the compound employed in this invention are listed below, but these examples are not intended to limit this invention.

EXAMPLES

| | |
|---|---|
| ($X_2$ - 1) | Ethylenediaminetetraacetic acid |
| ($X_2$ - 2) | Ethylenediaminetetraphosphoric acid |
| ($X_2$ - 3) | 1,2-Propylenediaminetetraacetic acid |
| ($X_2$ - 4) | Trimethylenediaminetetraacetic acid |
| ($X_2$ - 5) | Tetramethylenediaminetetraacetic acid |
| ($X_2$ - 6) | Pentamethylenediaminetetraacetic acid |
| ($X_2$ - 7) | Hexamethylenediaminetetraacetic acid |
| ($X_2$ - 8) | Octamethylenediaminetetraacetic acid |

-continued

| | |
|---|---|
| ($X_2$ - 9) | 1,2-Cyclopentadiaminetetraacetic acid |
| ($X_2$ - 10) | Trans-cyclohexane-1,2-diaminetetraacetic acid |
| ($X_2$ - 11) | Cyclohexane-1,3-diaminetetraacetic acid |
| ($X_2$ - 12) | Cyclohexane-1,4-diaminetetraacetic acid |
| ($X_2$ - 13) | 1,3,5-Triaminocyclohexanetetraacetic acid |
| ($X_2$ - 14) | o-Phenylenediaminetetraacetic acid |
| ($X_2$ - 15) | 2-Hydroxytrimethylenediaminetetraacetic acid |
| ($X_2$ - 16) | Ethyl-ether-diaminetetraacetic acid |
| ($X_2$ - 17) | Ethyl-thioether-diaminetetraacetic acid |
| ($X_2$ - 18) | Diethylenetriaminepentaacetic acid |
| ($X_2$ - 19) | Glycol-ether-diaminetetraacetic acid |
| ($X_2$ - 20) | Thioglycol-thioether-diaminetetraacetic acid |
| ($X_2$ - 21) | N,N'-Dimethyltrimethylenetetraamine-N'',N'',N''',N'''-tetraacetic acid |
| ($X_2$ - 22) | Ethylenediamine-N,N'-diacetic acid-N,N'-dipropionic acid |
| ($X_2$ - 23) | Trimethylenetetraaminehexaacid-nitrilotriacetic acid |
| ($X_2$ - 24) | Carboxyethyliminodiacetic acid |
| ($X_2$ - 25) | Carboxymethyliminodipropionic acid |
| ($X_2$ - 26) | Nitrilotripropionic acid |

Examples of the compound represented by Formula (II) employed in this invention are listed below, but these examples are not intended to limit this invention.

EXAMPLES

| | |
|---|---|
| II - 1 | Cerium salt of diethylenetriaminepentaacetic acid-2,3,5-triphenyltetrazolium |
| II - 2 | Cobalt salt of glycol-ether-diaminetetraacetic acid-2,3-diphenyl-5-mercaptotetrazolium |
| II - 3 | Iron salt of ethylenediaminetetraacetic acid-2,3,5-triphenyltetrazolium |
| II - 4 | Iron salt of trans-cyclohexane-1,2-diaminetetraacetic acid-2,3,5-triphenyltetrazolium |
| II - 5 | Cobalt salt of ethylenediaminetetraacetic acid-2-(tolyl)-3,5-diphenyltetrazolium |
| II - 6 | Iron salt of ethylenediaminetetrapropionic acid-2,3-diphenyl-5-mercaptotetrazolium |
| II - 7 | Iron salt of ethyl-ether-diaminetetraacetic acid-2,3-carboxy-5-phenyltetrazolium |
| II - 8 | Lead salt of pentamethylenediaminetetraacetic acid-2,3-hydroxy-5-phenyltetrazolium |
| II - 9 | Copper salt of hexamethylenediaminetetraacetic acid-2,3,5-triphenyltetrazolium |
| II - 10 | Europium salt of ethylenediaminetetraacetic acid-2-(p-hydroxyphenyl)-3,5-diphenyltetrazolium |
| II - 11 | Ytterbium salt of trimethylenediaminetetraacetic acid-2-(p-nitrophenyl)-3,5-diphenyltetrazolium |
| II - 12 | Ytterbium salt of ethylenediaminetetraacetic acid-2,3,5-triphenyltetrazolium |
| II - 13 | Cobalt salt of ethylenediaminetetraacetic acid-2,3-diphenyl-5-cyanotetrazolium |
| II - 14 | Samarium salt of ethylenediaminetetraacetic acid-2,3,5-triphenyltetrazolium |
| II - 15 | Nickel salt of ethylenediaminetetraacetic acid-2,3-diphenyl-5-(p-methylphenyl)tetrazolium |
| II - 16 | Cerium salt of ethylenediaminetetraacetic acid-2,3,5-triphenyltetrazolium |
| II - 17 | Iron salt of 2-hydroxytrimethylenediaminetetraacetic acid-2,3,5-triphenyltetrazolium |
| II - 18 | Iron salt of ethylenediaminetetraacetic acid-2,3,5-triphenyltetrazolium |
| II - 19 | Cobalt salt of ethylenediaminetetraacetic acid-2,3,5-triphenyltetrazolium |
| II - 20 | Iron salt of ethylenediaminetetraphosphoric acid-2,3,5-triphenyltetrazolium |

The compound represented by Formula (II) of this invention can be readily prepared, in the same manner for the preparation of the compound represented by Formula (I), by combining optionally a halide (e.g., chloride or bromide) containing the cation part T and an alkali metal salt of the metal-chelate compound containing the anion part $X_2$.

The compound of Formula (II) which can be prepared by using a tetrazolium halide TX containing the cation part T and an alkali metal salt of the metal-chelate compound $X_2K$ containing the anion part $X_2$ may be incorporated into a hydrophilic colloid of a light-sensitive silver halide photographic material, wherein X and T represent a halogen atom and an alkali metal, respectively. Alternatively, the compound TX and the compound $X_2K$, each in the form in a solution of an appropriate solvent or a dispersion in a latex of a gelatin matrix, can be incorporated into a hydrophilic colloid of a light-sensitive silver halide photographic material, whereby the compound of Formula (II) is prepared.

The light-sensitive silver halide photographic material of this invention comprises a support, and on the support a hydrophilic colloidal layer comprising at least one silver halide emulsion layer is coated. The silver halide emulsion layer can be coated on a support directly, or firstly a hydrophilic colloidal layer comprising no silver halide emulsion layer is coated on a support, secondly a silver halide emulsion layer is coated thereon, and lastly a hydrophilic colloidal layer is coated thereon for protection. The silver halide emulsion layer can be divided to become two or more layers, and in this case an intermediate layer can be placed between the multiple silver halide emulsion layers or between the silver halide emulsion layers and the protective layer. The layer in which the compound of this invention is incorporated is a hydrophilic colloidal layer, and preferably is either or both of the silver halide emulsion layer and/or a hydrophilic colloidal layer adjacent to said silver halide emulsion layer.

The compounds represented by Formula (I) and Formula (II) are incorporated in the silver halide emulsion layer respectively in an amount ranging from $10^{-4}$ to $10^{-1}$ mol/mol of silver, preferably from $10^{-3}$ to $10^{-2}$ mol/mol of silver, and more preferably from $5\times10^{-3}$ to $5\times10^{-2}$ mol/mol of silver. The ratio of the compound of Formula (I) against the compound of Formula (II) is preferably from $10^{-3}$ to $10^{3}$ and more preferably from $10^{-1}$ to 10. The compound of Formula (I) and the compound of Formula (II) can be incorporated in the silver halide emulsion in a manner usally adopted for incorporation of additives into a silver halide emulsion. For instance, if the compound is soluble in water, it can be incorporated in the form of an aqueous solution of an appropriate concentration. If the compound is not or sparingly soluble in water, it can be incorporated in the form of a solution in a water-miscible organic solvent such as an alcohol, an ether, a glycol, an acetone, an ester, an amine or the like. Otherwise employed, for instance, is a known method for incorporating a water-insoluble coupler into the emulsion in the form a dispersion.

The compound of this invention can be incorporated in a single silver halide emulsion layer or in multiple silver halide emulsion layers. The compound of Formula (I) and the compound of Formula (II) can be together incorporated in a single layer or separately incorporated in multiple layers. If the compound of Formula (I) and/or the compound of Formula (II) are incorporated in a light-insensitive hydrophilic colloidal layer, said layer can be selected optionally from an intermediate layer, a protecting layer, a backing layer, etc.

A preferable embodiment of a photographic material of the present invention contains a hydrophilic colloidal layer containing a silver halide emulsion and a hydrophilic colloidal layer containing no silver halide emulsion coated on a support at this order and one layer is adjacent to the other. Further preferably both layers contain the compounds of the Formulae (I) and (II), and a concentration of total amount of the said compound to a hydrophilic colloid of the hydrophilic colloidal layer containing no silver halide emulsion is from 1.2 to 10 times greater than the concentration of the hydrophilic colloidal layer containing a silver halide emulsion.

Examples of the silver halide employed in this invention include silver chloride, silver chlorobromide, silver iodochlorobromide, silver bromide and silver iodobromide. If silver chlorobromide or silver iodochlorobromide is employed, silver bromide contained in it is preferably up to 50 mol %. If silver iodobromide or silver iodochlorobromide is employed, silver iodide contained in it is preferably up to 10 mole %.

The silver halide used for practising the present invention can be prepared in any methods known to a person skill in the art. The silver halide can be advantageously applied such methods as the conversion method disclosed in U.S. Pat. No. 2,592,250 and the shelling method disclosed in Japanese Patent Provisional Publication 50(1978)-56,226 so as to enhance the developing capacity at a higher exposed part.

For the purpose of accomplishing higher contrast, a narrower range of the silver halide grain size distribution is preferred and, particularly, sizes of 80% of the whole number of the grains are preferably within the range of ±40% deviation from the average grain size with respect to the weight and number of the silver halide grains. For this reason, the preparation of the silver halide is preferably carried out by the pAg regulating simultaneous mixing method in which the reaction between a water-soluble silver salt and a water-soluble halide is done in a liquid phase maintaining the pAg constant or by the functionally adding simultaneous mixing method in which a water-soluble silver salt and a water-solubel halide are added in amounts varying proportionally to the surface area of the silver halide under crystal growing. The average grain size of the obtained silver halide preferably is smaller from the viewpoints of the development progress and halftone formation, but preferably is larger from the viewpoint of the sensitivity. The average grain size satisfying these requests is within 0.15μ to 0.8μ.

In the process for preparing the photographic material involving the compounds of this invention, two or more kinds of silver halides can be employed after mixing, or each of these silver halides can be successively overlaid in the form of a separated layer.

When the silver halide grains are being formed or being physically ripened, a cadmium salt, a zinc salt, a lead salt, a thallium salt, an iridium salt, an iridium complex salt, a rhodium salt, a rhodium complex salt, an iron salt, an iron complex salt, etc. can be together present in the phase.

The silver halide emulsion employed in this invention can be sensitized by the use of a variety of chemical sensitizers.

The silver halide emulsion used in this invention is optically sensitized by the use of one or more sensitizing dyes so as to impart the emulsion the sensitivity in the desired wavelength area.

The hydrophilic colloid which forms the hydrophilic colloidal layer is generally made of gelatin. Said hydrophilic colloid can be applied to such layers containing no silver halide as antihalation layer, protective layer, intermediate layer, underlayer, filter layer, backing layer, etc. The preferred hydrophilic colloids are gelatin and/or the gelatin derivatives.

The light-sensitive silver halide photographic material of this invention can be prepared by coating the aforementioned layers on an appropriate photographic support. Examples of the support include baryta paper, polyethylene-coated paper, synthetic polypropylene paper, glass plate, cellulose acetate film, cellulose nitrate film, polyester film such as polyethylene terephthalate film, etc. The support is optionally selected depending on the purpose for which the light-sensitive photographic material is employed.

As stated above, the light-sensitive silver halide photographic material of this invention comprises at least one hydrophilic colloidal layer containing silver halide coated on a support. Preferably, the light-sensitive silver halide photographic material of this invention is coated with a protective layer generally made of gelatin having an appropriate film thickness, for instance, 0.1μ–10μ, preferably 0.8μ–2μ.

Previously known lith-type light-sensitive silver halide photographic materials generally contain protective layers. However, the protective layer which may be employed in this invention serves for imparting a very important function being different from the functions usually known.

In a general sense, the protective layer is provided for protecting the silver halide emulsion layer from undesired damages, for example, damages received in the cutting, rolling and packing stages in the process for the preparation of light-sensitive silver halide photographic materials or damages received by contacts of the photographic material with other materials in the course of taking picture or processing. The protective layer optionally applied to the invention serves an important role for the processing stability as well as the role stated above. The reason why the protective layer can effectively function for stabilizing the quality of images and development is not known. It is assumed that the protective layer can effectively control the penetrating rate of such a developing agent as hydroquinone, Methol ®(p-methylaminophenol sulfate) or Phenidone ®(1-phenyl-3-pyrazolidone) from the processing solution to the light-sensitive silver halide photographic material, the diffusion property of the compounds of Formula (I) and Formula (II) in the photographic material, or the diffusion property of said compounds from the photographic material to the processing solution.

An image can be obtained by exposing and then processing the photographic material of the present invention. The image obtained according to the process using the photographic material of this invention is a silver image with high contrast. Therefore, the present invention can be applied in the art that requires the high contrast balck-and-white recording, and preferably is employed as light-sensitive materials for the printing use, microphotography, etc. The present invention provides excellent characteristics in the formation of the lith-type photographic image as compared with the conventional art.

The developer employed for the process involving the material of this invention is, not necessarily, the so-called lith-type developer, and even in the presence of a sulfite ion of a high concentration the high-contrast silver image can be obtained. This process does not require, but may employ, conventional hydroquinone, alkali, alkali metal bromide and a sulfite ion of a low concentration, as well as such a preserving agent as formaldehyde-sodium bisulfite or a carbonyl bisulfiteamine condensation which are conventionally employed in the so-called lith-type developing agent. The developer containing the developing agent employed for the present invention is not only the so-called lith-type developer but also the so-called MQ or PQ developer. Said MQ or PQ developer is advantageously used in the present process due to excellency in the preparation and preservation of the solution.

The developing agents described in C.E.K. Mees, T. H. James: The Theory of the Photographic Process, 3rd Ed., pages 278–311, and in Journal of the American Chemical Society, 73, 3100 (1951) are effectively employed for the present process.

The developing agent can be applied singly or in combination of two or more kinds. The latter is preferred. Examples of the preferred developing agent include a hydroquinone type, a p-aminophenol type, a 3-pyrazolidone type and a p-phenylenediamine type. The developing solution employed in this process can contain sodium sulfite, potassium sulfite, ammonium sulfite, or other sulfites as the preserving agent, not disturbing the effect of the present invention. This is one of the characteristics of this invention. The sulfite is preferably contained in a developer in an amount of $1\times10^{-1}$-1 mol/l. Such a preserving agent as hydroxylamine, ethanolamne, alkanolamine sulfite adduct or hydrazide can be also contained. Also optionally added are the pH regulator such as a caustic alkali, an alkali carbonate being preferably added to the developer in an amount of $1\times10^{-1}$-2 mol/l, or an amine, such pH regulators being capable of functioning as buffers, an inorganic development retarder such as pottasium bromide, an organic development retarder such as a triazol, tetrazol, benzimidazole, benztriazole, benzthiazole, benzoxazole, and indazole, a metal ion capturer (sequestering agent) such as ethylenediaminetetraacetate, a developing accelerator such as methanol, ethanol, benzyl alcohol or polyalkylene oxide, a surfactant such as sodium alkylarylsulfonate, a hardening agent such as glutaraldehyde, formalin or glyoxal, and an ion strength regulator such as sodium sulfate.

The light-sensitive silver halide photographic material of this invention can be processed under different conditions. The temperature of the developer in the course of the processing generally ranges from 15° to 60° C., preferably is around 30° C. The developing time is generally up to 10 minutes, and the period of up to 5 minutes is preferred to achieve a satisfactory result. The developer preferably has pH 8 to 12, more preferably pH 9 to 11. Optionally employed and optionally omitted are other stages than the developing such as the washing with water, stopping, stabilizing, fixing, pre-hardening and neutralizing.

The one preferred embodiment of this invention showed the storage stability of more than twenty times as long as that of the conventional lith-type developer, both having been determined in the plate processing. The conventional special developer that contains an extremely reduced sulfite concentration, that is, the lith-type developer, and that is employed to improve the halftone property of the lith-type light-sensitive silver halide photographic material so deteriorates within a few hours that it cannot be practically used. In contrast, a preferred embodiment of the developer of this invention can be still used practically after one month or more, maintaining the halftone property almost similar to that yielded by the use of a fresh developer. To the developer used for this invention can be added such additives as ones generally added to the conventional high-contrast developer, for instance, a high contrasting agent and an agent reducing a density at low density part.

The light-sensitive silver halide photographic material composed as stated hereinbefore has high contrast and excellent storage stability as described above. Moreover, it can improve other characteristics in the processing: that is, (1) reduction of unevenness of development due to unniform stirring of the developer during the processing, (2) making the developing speed moderate to eliminate a steep growing of fog in the latter period of the development and (3) improving the reduction of a silver image of the sample after the processing.

This invention will be further illustrated by the following examples including the reference examples, but these examples are not to be intended to limit this invention. Therefore, this invention can be embodied in different ways within the claims.

EXAMPLE 1

A gelatin emulsion of silver chlorobromide (silver chloride: 90 mole %, silver bromide: 10 mole %, average grain size: 0.3μ) 90% of which grain total number had the grain size of 0.7 to 1.3 times as much as the average grain size was chemically sensitized with a sulfur sensitizing agent and a gold sensitizing agent. The obtained emulsion was divided into several portions, and to each were added the compounds of this invention as shown in Table 1, a coating aid and a hardening agent.

The emulsion was then coated on a support made of polyethylene terephthalate in the ratios of 50 mg of silver and 35 mg of gelatin per 100 $cm^2$ of the area of the support. On the resulting silver halide emulsion layer was coated a protective gelatin layer (15 mg/100 $cm^2$), and the obtained sample was further treated as follows.

For comparison of the photographic characteristics, the sample thus obtained was wedge-exposed through the tugsten light contact screen (150 L chain-dot type for the preparation of negative) and treated in the manner described below.

The storage stability of the sample was examined as follows: The coated and dried sample was kept for 24 hours in a room at a relative humidity (RH) of 50% and a temperature of 23° C. In the same room, the sample was then inserted into an air-tight envelop for the light-sensitive material, kept for one day or ten days in a preserving vessel maintained at 65° C., and taken out for exposure and development. Another sample was prepared by keeping in a room at RH 50% and 23° C. The other sample was, in contrast, exposed and developed immediately after the coating and drying. After the processing, these samples were examined on their photographic characteristics.

The quality of halftone was judged by examining microscopically the dot-image. The balckened concentration 50% part, namely, the almost central part between the shadow part and the highlight part, was examined, and the marks 7 and 1 were given to the best and the worst, respectively. Between the best and the worst, seven ranks were allotted. The relative sensitivity was calculated based on the quantity of light required for giving the blackened concentration 50%. The results are set out in Table 1. The examination as to the storage stability and the quality of halftone are applied to other Examples.

| Processing details (30 min.) | |
|---|---|
| Development (1 min.) - Fixing (1 min.) - Washing with water (1 min.) - Drying (40 sec.) | |
| **Developer** | |
| Methol ® (p-methylaminophenol sulfate) | 3.5 g |
| Anhydrous sodium sulfite | 50 g |
| Hydroquinone | 10 g |
| Sodium carbonate . monohydrate | 50 g |
| Potassium bromide | 3 g |
| Sodium ethylenediaminetetraacetate | 0.5 g |
| 5-Nitroindazole | 60 mg |
| Water was added to make the volume to one liter and this was then adjusted to pH 10.0. | |
| **Fixing solution** | |
| Ammonium thiosulfate . 10 hydrates | 150 g |
| Anhydrous sodium sulfite | 10 g |
| Sodium acetate . 3 hydrates | 15 g |
| Glacial acetic acid | 17 g |
| Water was added to make the volume to one liter and this was then adjusted to pH 4.20. | |

(I) has satisfactory photographic characteristics not only when processed just after the coating but also when processed after standing.

EXAMPLE 2

A gelatin emulsion of silver bromide (average grain size: 0.35μ) 90% of which grain total number had the grain sizes ranging from 0.25μ to 0.45μ was chemically sensitized with a sulfur sensitizing agent and a gold sensitizing agent. The obtained emulsion was divided into several portions, and to each were added the compounds of this invention as shown in Table 2, a coating aid, a stabilizer, an antifoggant, and a hardening agent.

The emulsion was then coated on a support made of polyethylene terephthalate in the ratios of 48 mg. of silver and 38 mg. of gelatin per 100 $cm^2$ of the area of the support. On the resulting silver halide emulsion layer was coated a protective gelatin layer (15 mg/100 $cm^2$), and the obtained sample was preserved, exposed and processed in the manner as employed in Example 1, except that the developer of the following formulation was used instead of the one stated in Example 1. The results are set out in Table 2.

| Developer | |
|---|---|
| Phenidone ® (1-phenyl-3-pyrazolidone) | 3 g. |
| Anhydrous sodium sulfite | 60 g. |
| Hydroquinone | 10 g. |
| Sodium carbonate . monohydrate | 50 g. |
| Potassium bromide | 2.5 g. |
| Sodium ethylenediaminetetraacetate | 1.0 g. |
| 5-Nitrobenzimidazole | 5 g. |
| Water was added to make the volume to one liter and this was then adjusted to pH 10.8. | |

TABLE I

| | | | | | Preserving Conditions | | | | | | | | | | | |
|---|---|---|---|---|---|---|---|---|---|---|---|---|---|---|---|---|
| | | | | | 23° C., RH 50% | | | | | | | | | | | |
| | | | | | Immediately after coating | | | After 6 months | | | Enveloped sample (preserved at 65° C.) | | | | | |
| | | | | | | | | | | | One day | | | Ten days | | |
| Sample | Compound of Formula (I) (mol/mol Ag) | | Compound of Formula (II) (mol/mol Ag) | | Sensitivity | Fog | Halftone quality | Sensitivity | Fog | Halftone quality | Sensitivity | Fog | Halftone quality | Sensitivity | Fog | Halftone quality |
| 1 | I - 10 | $1 \times 10^{-3}$ | | | 100 | 0.04 | 7 | 250 | 0.50 | 3 | 260 | 0.90 | 3 | 300 | 1.0 | 1 |
| 2 | I - 2 | $2 \times 10^{-3}$ | II - 8 | $2.3 \times 10^{-4}$ | 100 | 0.04 | 7 | 100 | 0.04 | 7 | 100 | 0.04 | 7 | 103 | 0.04 | 6 |
| 3 | I - 2<br>I - 5 | $1 \times 10^{-3}$<br>$1 \times 10^{-5}$ | II - 3 | $4 \times 10^{-4}$ | 102 | 0.04 | 7 | 100 | 0.04 | 7 | 100 | 0.04 | 7 | 100 | 0.03 | 6 |
| 4 | I - 4 | $1.3 \times 10^{-3}$ | II - 6 | $3 \times 10^{-5}$ | 101 | 0.04 | 6 | 98 | 0.04 | 6 | 98 | 0.04 | 6 | 110 | 0.04 | 6 |
| 5 | I - 3 | $2 \times 10^{-3}$ | II - 5 | $1.5 \times 18^{-3}$ | 100 | 0.04 | 7 | 102 | 0.04 | 6.5 | 102 | 0.04 | 6.5 | 103 | 0.04 | 6.5 |
| 6 | I - 6 | $3 \times 10^{-4}$ | II - 7 | $3 \times 10^{-3}$ | 101 | 0.04 | 6.5 | 102 | 0.04 | 6.3 | 102 | 0.04 | 6.5 | 95 | 0.04 | 6.3 |
| 7 | I - 7 | $2 \times 10^{-3}$ | II - 9 | $2.3 \times 10^{-3}$ | 100 | 0.04 | 6 | 100 | 0.04 | 6 | 100 | 0.04 | 6 | 95 | 0.04 | 6 |
| 8 | I - 10 | $2.3 \times 10^{-3}$ | II - 4 | $4 \times 10^{-4}$ | 100 | 0.07 | 6 | 97 | 0.03 | 6 | 97 | 0.04 | 6 | 100 | 0.04 | 6 |
| 9 | I - 12 | $5 \times 10^{-3}$ | II - 13 | $1.5 \times 10^{-3}$ | 100 | 0.04 | 7 | 105 | 0.04 | 7 | 103 | 0.04 | 7 | 103 | 0.04 | 6.5 |
| 10 | I - 15 | $1.5 \times 10^{-3}$ | II - 15 | $2.0 \times 10^{-3}$ | 102 | 0.04 | 6.5 | 103 | 0.03 | 6.5 | 103 | 0.04 | 6.5 | 105 | 0.04 | 6.5 |

As seen from the reslts set out in Table 1, the sample containing only the compound of Formula (I) has higher halftone quality and shows less fog when it is processed just after the coating. After allowing to stand for six months at 25° C. and 50%, RH, or keeping for one or ten days at 65° C. in a sealed envelop, the halftone quality lowers, the fog increases and the sensitivity varies, all these changes being apparent.

In contrast, the sample containing the compound of Formula (II) together with the compound of Formula

TABLE 2

| | | | | | Preserving Conditions | | | | | | | | | | | |
|---|---|---|---|---|---|---|---|---|---|---|---|---|---|---|---|---|
| | | | | | 23° C., RH 50% | | | | | | | | | | | |
| | | | | | Immediately after coating | | | After 6 months | | | Enveloped sample (preserved at 65° C.) | | | | | |
| | | | | | | | | | | | One day | | | Ten days | | |
| Sample | Compound of Formula (I) (mol/mol Ag) | | Compound of Formula (II) (mol/mol Ag) | | Sensitivity | Fog | Halftone quality | Sensitivity | Fog | Halftone quality | Sensitivity | Fog | Halftone quality | Sensitivity | Fog | Halftone quality |
| 1 | I - 3 | $2 \times 10^{-3}$ | | | 100 | 0.04 | 7 | 250 | 0.50 | 3 | 260 | 0.90 | 3 | 300 | 1.0 | 1 |
| 2 | I - 5 | $2 \times 10^{-2}$ | II - 1<br>II - 2 | $2 \times 10^{-3}$<br>$0.5 \times 10^{-3}$ | 100 | 0.04 | 7 | 100 | 0.04 | 7 | 100 | 0.04 | 6 | 98 | 0.05 | 6 |
| 3 | I - 6 | $3 \times 10^{-3}$ | II - 3 | $3 \times 10^{-3}$ | 100 | 0.04 | 7 | 100 | 0.04 | 7 | 100 | 0.04 | 6 | 97 | 0.04 | 6 |
| 4 | I - 7 | $3 \times 10^{-3}$ | II - 2 | $2.5 \times 10^{-3}$ | 100 | 0.04 | 6 | 99 | 0.03 | 6 | 98 | 0.04 | 5.9 | 98 | 0.05 | 5.8 |
| 5 | I - 10 | $2.5 \times 10^{-3}$ | II - 5 | $2 \times 10^{-3}$ | 101 | 0.04 | 6 | 100 | 0.03 | 6 | 97 | 0.04 | 6 | 97 | 0.04 | 6 |

TABLE 2-continued

| Sample | Compound of Formula (I) (mol/mol Ag) | | Compound of Formula (II) (mol/mol Ag) | | Preserving Conditions: 23° C., RH 50%, Immediately after coating: Sensitivity | Fog | Halftone quality | After 6 months: Sensitivity | Fog | Halftone quality | Enveloped sample (preserved at 65° C.), One day: Sensitivity | Fog | Halftone quality | Ten days: Sensitivity | Fog | Halftone quality |
|---|---|---|---|---|---|---|---|---|---|---|---|---|---|---|---|---|
| 6 | I - 15 | $2.5 \times 10^{-3}$ | II - 6 | $2 \times 10^{-3}$ | 103 | 0.04 | 6.5 | 105 | 0.04 | 6.3 | 100 | 0.04 | 6.3 | 99 | 0.04 | 6.0 |
| 7 | I - 13 | $3 \times 10^{-4}$ | II - 7 | $2 \times 10^{-3}$ | 102 | 0.04 | 7 | 100 | 0.05 | 7 | 98 | 0.04 | 6.8 | 95 | 0.03 | 6.5 |
| 8 | I - 11 | $3 \times 10^{-4}$ | II - 8 | $3.5 \times 10^{-3}$ | 98 | 0.04 | 7 | 100 | 0.04 | 7 | 98 | 0.04 | 7 | 98 | 0.04 | 6 |
| 9 | I - 9 | $2 \times 10^{-3}$ | II - 10 | $2 \times 10^{-3}$ | 100 | 0.04 | 6.5 | 103 | 0.05 | 6.5 | 99 | 0.04 | 6.5 | 99 | 0.04 | 6 |
| 10 | I - 1 | $2 \times 10^{-3}$ | II - 13 | $2 \times 10^{-3}$ | 102 | 0.04 | 7 | 102 | 0.05 | 7 | 100 | 0.04 | 7 | 100 | 0.04 | 7 |

As seen from the results set out in Table 1, the sample containing only the compound of Formula (I) has higher halftone quality and shows less fog when it is processed just after the coating. After allowing to stand for six months at 25° C. and 50% RH, or keeping for one or ten days at 65° C. in a sealed envelop, the halftone quality lowers, the fog increases and the sensitivity varies, all these changes being apparent.

In contrast, the sample containing the compound of Formula (II) together with the compound of Formula (I) has satisfactory photographic characteristics not only when processed just after the coating but also when processed after standing.

EXAMPLE 3

In this example, a silver halide emulsion having a desired average grain size, grain size distribution and halide formulation was prepared by mixing a water-soluble silver salt and a water soluble halide simultaneously in an aqueous gelatin under control of pAg, pH, temperature, etc., and the obtained emulsion was sensitized chemically. To the sensitized emulsion were added the compounds of this invention shown in Table 3, a coating aid and a hardening agent. The sample thus prepared was coated, preserved, exposed and processed in the manner as employed in Example 1. The results are set out in Table 3.

TABLE 3

| Silver halide: Halide formulation (mole % ratio) | Average grain size (μ) | Grain size* | Compound of Formula (I) (mol/mol Ag) | | Compound of Formula (II) (mol/mol Ag) | | Preserving conditions: Immediately after coating: Halftone quality | Fog | Enveloped sample (at 65° C., 10 days): Halftone quality | Fog |
|---|---|---|---|---|---|---|---|---|---|---|
| Silver halide | 0.5 | 80 | I - 5 | $3 \times 10^{-3}$ | II - 3 | $3 \times 10^{-3}$ | 7 | 0.04 | 6 | 0.04 |
| " | 0.35 | 60 | I - 5 | $4 \times 10^{-2}$ | II - 3 | $4 \times 10^{-2}$ | 5 | 0.04 | 4 | 0.30 |
| Silver iodobromide (AgBr 98, AgI2) | 0.35 | 90 | I - 10 | $2 \times 10^{-3}$ | II - 5 | $3 \times 10^{-2}$ | 7 | 0.04 | 6 | 0.04 |
| Silver iodobromide (AgBr 98, AgI 2) | 0.35 | 60 | I - 8 | $2 \times 10^{-3}$ | II - 8 | $3 \times 13^{-3}$ | 5 | 0.04 | 4 | 0.30 |
| Silver chlorobromide (AgCl 80, AgBr 20) | 0.25 | 95 | I - 7 | $2 \times 10^{-3}$ | II - 13 | $3 \times 10^{-5}$ | 7 | 0.04 | 7 | 0.04 |
| Silver chlorobromide (AgCl 80, AgBr 20) | 0.35 | 55 | I - 5 | $6 \times 10^{-3}$ | II - 15 | $6 \times 10^{-3}$ | 7 | 0.04 | 5 | 0.40 |
| Silver chloro-iodobromide (AgCl 70, AgBr 29, AgI 1) | 0.25 | 95 | I - 11 | $3 \times 10^{-3}$ | II - 13 | $2 \times 12^{-3}$ | 7 | 0.04 | 7 | 0.04 |
| Silver chloro-iodobromide (AgCl 70, AgBr 29, AgI 1) | 1.5 | 80 | I - 5 | $2 \times 10^{-3}$ | II - 10 | $3 \times 10^{-3}$ | 5 | 0.04 | 2 | 0.10 |

Note:
*Number of grains having grain size of 0.6–1.4 times as much as the average grain size/Number of whole grains As seen from the results set out in Table 3, the photographic materials containing the silver halide grains whose average grain size is within 0.1μ–0.8μ and which have narrower grain size distribution, that is, which have higher numbers (e.g., not less than 80%) of grains having the grain size of 0.6–1.4 times as much as the average grain size are higher in the contrast and the halftone quality, and moreover excellent in the storage stability.

We claim:

1. A photographic material comprising a light-sensitive silver halide emulsion layer coated on a support which material contains a combination of a salt of tetrazolium containing only a non-metallic anion and a salt of tetrazolium containing a metallic anion, said metallic anion being a complex salt of an organic multivalent aminomultivalent carboxylic acid with a metal selected from the group consisting of iron, cobalt, nickel, copper, lead, chromium, titanium, cerium, samarium, europium and ytterbium, the valency of said metal ions being divalent for copper, trivalent for iron, cobalt, nickel, samarium, europium, chromium and ytterbium, and tetravlent for titanium, cerium, and lead in at least one of said silver halide emulsion layer or in a hydrophilic colloid layer adjacent to said silver halide emulsion layer.

2. A photographic material as claimed in claim 1 wherein the metallic anion is an iron (III), cobalt (III) or nickel (III) complex salt of an organic multivalent amino-multivalent carboxylic acid.

3. A photographic material as claimed in claim 1 wherein the salt of tetrazolium containing only a non-metallic anion is represented by the following Formula (I): $[T^{n\oplus}][X_1\ominus]_n$, in which T represents a tetrazolium cation, $X_1$ represents an anion containing only non-metalic atoms, and n is an integer of 1 or 2.

4. A photographic material as claimed in claim 1 wherein said salt of tetrazolium containing only a non-metallic anion and said salt of tetrazolium containing a metallic anion are in the silver halide emulsion layer.

5. A photographic material as claimed in claim 1 or 4 wherein said salt of tetrazolium containing only a non-metallic anion and said salt of tetrazolium containing a metallic anion are each in an amount of $10^{-5}$-10 mol per 1 mol silver halide.

6. A photographic material as claimed in claim 3 wherein T consisting in Formula (I) represents triphenyltetrazolium and $X_1$ represents an alkylsuccinic acid ester sulfonate.

7. A photographic material as claimed in claim 2 wherein the metallic anion is an iron (III) complex salt of an organic multivalent amino-multivalent carboxylic acid.

8. A process for developing a photographic material comprising a light-sensitive silver halide emulsion layer coated on a support which material contains a combination of a salt of tetrazolium containing only a non-metallic anion and a salt of tetrazolium containing a metallic anion, said metallic anion being a complex salt of an organic multivalent aminomultivalent carboxylic acid with a metal selected from the group consisting of iron, cobalt, nickel, copper, lead, chromium, titanium, cerium, samarium, europium and ytterbium, the valency of said metal ions being divalent for copper, trivalent for iron, cobalt, nickel, samarium, europium, chromium and ytterbium, and tetravalent for titanium, cerium, and lead in at least one of said silver halide emulsion layer or in a hydrophilic colloid layer adjacent to said silver halide emulsion layer; said process comprising image-wise exposing said photographic material and then developing said photographic material with a developer containing from 5 to 300 g/liter of a sulfite.

9. The process of claim 8 wherein said photographic material is developed with a developing solution containing p-methylaminophenol sulfate or 1-phenyl-3-pyrazolidone-hydroquinone or mixtures thereof.

10. The process of claim 8 or 9 wherein said developer also contains from 5 to 300 g/liter of a carbonate.

* * * * *

UNITED STATES PATENT AND TRADEMARK OFFICE

CERTIFICATE OF CORRECTION

PATENT NO. : 4,318,979

DATED : March 9, 1982

INVENTOR(S) : TAKESHI HABU et al

It is certified that error appears in the above—identified patent and that said Letters Patent is hereby corrected as shown below:

Column 9, in the last formula appearing at bottom of column, that portion of the formula reading " N— Z —N " should read -- 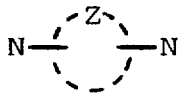 --.

Column 10, line 27: "$COO^{63}$" should be --$COO^{\ominus}$ --.

Column 10, line 28: "[$T^{61}$]" should be --[$T^{\oplus}$ ]--.

Column 14, line 60: "balck" should be --black--.

Column 16, line 64; "balckened" should be --blackened--.

Columns 17 and 18, TABLE 1: 4th column, 4th line, "II-5" should be -- II-2/II-5 --; 7th column, 8th line, "0.07" should be --0.04--; 11th column, 6th line, "6.3" should be --6.5--; 12th column, penultimate line, "103" should be --105--; 15th column, 6th and 7th lines, "95" should be --98--, and penultimate line, "103" should be--105--; last column, 6th line, "6.3" should be --6.5--.

UNITED STATES PATENT AND TRADEMARK OFFICE

CERTIFICATE OF CORRECTION

PATENT NO. : 4,318,979

DATED : March 9, 1982

INVENTOR(S) : TAKESHI HABU et al

It is certified that error appears in the above—identified patent and that said Letters Patent is hereby corrected as shown below:

Column 17, line 46: "reslts" should be --results--.

Columns 19 and 20, TABLE 3: 7th column, 4th line, the value "$3 \times 13^{-3}$" should be -- $3 \times 10^{-3}$ --.

Signed and Sealed this

*Second* Day of *November 1982*

[SEAL]

*Attest:*

GERALD J. MOSSINGHOFF

*Attesting Officer* *Commissioner of Patents and Trademarks*